US008939664B2

(12) United States Patent
Aoki

(10) Patent No.: US 8,939,664 B2
(45) Date of Patent: Jan. 27, 2015

(54) MEDIUM TRANSPORT APPARATUS, IMAGE FORMING APPARATUS, METHOD FOR DETERMINING SPLICE ON MEDIUM AND COMPUTER READABLE MEDIUM

(75) Inventor: Hiroyuki Aoki, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 222 days.

(21) Appl. No.: 13/034,953

(22) Filed: Feb. 25, 2011

(65) Prior Publication Data

US 2012/0070160 A1 Mar. 22, 2012

(30) Foreign Application Priority Data

Sep. 22, 2010 (JP) ..... 2010-211571

(51) Int. Cl.
*B41J 15/00* (2006.01)
*G03G 15/00* (2006.01)
*B41J 11/46* (2006.01)

(52) U.S. Cl.
CPC ..... *G03G 15/652* (2013.01); *G03G 15/5029* (2013.01); *B65H 2301/46018* (2013.01); *B65H 2801/21* (2013.01)
USPC ..... 400/611; 399/384

(58) Field of Classification Search
CPC ..... B65H 2301/46018
USPC ..... 399/384; 400/611; 270/30.02
See application file for complete search history.

(56) References Cited

U.S. PATENT DOCUMENTS

| | | | | |
|---|---|---|---|---|
| 4,314,757 | A | 2/1982 | Anderson et al. | |
| 4,901,577 | A | 2/1990 | Roberts | |
| 5,243,408 | A | 9/1993 | Whitman, III | |
| 5,953,953 | A | 9/1999 | Allmann et al. | |
| 6,292,635 | B1 * | 9/2001 | Tokairin et al. | 399/15 |
| 6,520,080 | B1 * | 2/2003 | Fried | 101/227 |
| 6,575,546 | B2 | 6/2003 | Matsumoto et al. | |

FOREIGN PATENT DOCUMENTS

| | | | |
|---|---|---|---|
| JP | 6-324536 | A | 11/1994 |
| JP | 2002-104701 | A | 4/2002 |
| JP | 2005-231062 | A | 9/2005 |
| JP | 3898142 | B2 | 1/2007 |

OTHER PUBLICATIONS

Australian Examiner's Report issued on Sep. 18, 2012 in Australian Patent Application No. 2011200772.

* cited by examiner

*Primary Examiner* — Daniel J Colilla
*Assistant Examiner* — John M Royston
(74) *Attorney, Agent, or Firm* — Sughrue Mion, PLLC

(57) ABSTRACT

A medium transport apparatus includes: a transport unit transporting a belt-shaped medium having plural marks formed in line at predetermined intervals in a transport direction; a detection unit detecting the marks on the medium; and a determining unit determining that a splice exists at a position on the medium if an interval of the marks detected from the medium by the detection unit differs from the predetermined intervals, the position being identified by the marks having the interval different from the predetermined intervals.

2 Claims, 8 Drawing Sheets

MEDIUM TRANSPORT APPARATUS, IMAGE FORMING APPARATUS, METHOD FOR DETERMINING SPLICE ON MEDIUM AND COMPUTER READABLE MEDIUM

CROSS REFERENCE TO RELATED APPLICATIONS

This application is based on and claims priority under 35 USC §119 from Japanese Patent Application No. 2010-211571 filed Sep. 22, 2010.

BACKGROUND

1. Technical Field

The present invention relates to a medium transport apparatus, an image forming apparatus, a method for determining a splice on a medium and a computer readable medium storing a program.

2. Related Art

There is known an apparatus detecting a splice of a material web roll having a splice and formed by winding up that web into a roll shape which is made of long-length belt-shaped films or sheet members spliced with each other at edges thereof.

SUMMARY

According to an aspect of the present invention, there is provided a medium transport apparatus including: a transport unit transporting a belt-shaped medium having plural marks formed in line at predetermined intervals in a transport direction; a detection unit detecting the marks on the medium; and a determining unit determining that a splice exists at a position on the medium if an interval of the marks detected from the medium by the detection unit differs from the predetermined intervals, the position being identified by the marks having the interval different from the predetermined intervals.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

Figure 1:
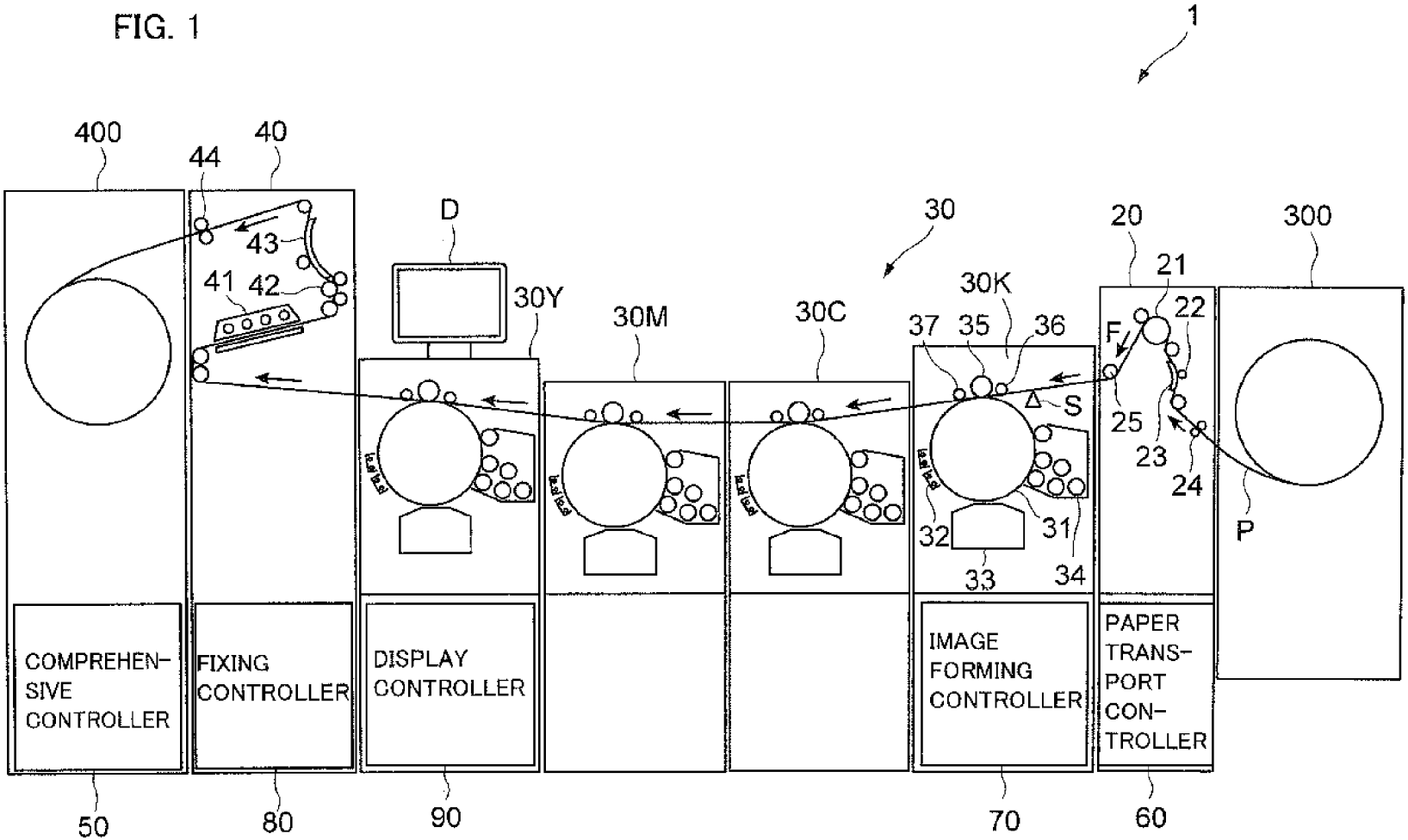
FIG. 1 is a diagram showing an overall configuration of an image forming apparatus of the exemplary embodiment.

FIG. 1 is a diagram showing an overall configuration of an image forming apparatus 1 of the present exemplary embodiment.

The image forming apparatus 1 shown in FIG. 1 is a so-called continuous feed printer forming an image on continuous paper P that is a medium formed into a belt shape. The image forming apparatus 1 is an image forming apparatus of an electrophotographic system, for example. From the upstream side to the downstream side in a transport direction (an arrow F in FIG. 1) of the continuous paper P, the image forming apparatus 1 includes: a continuous paper feeder 300 feeding the continuous paper P; a paper transport unit 20 that transports and drives the continuous paper P coming from the continuous paper feeder 300; an image forming unit 30 forming a toner image on the continuous paper P; a fixing unit 40 fixing color toner images formed on the continuous paper P; and a continuous paper winder 400 winding up the continuous paper P subjected to image formation. The image forming apparatus 1 also includes a display D receiving input for image display, instructions and the like.

The paper transport unit 20, which is an example of a transport unit, includes back tension rolls 24, an aligning roll 22, a main drive roll 21 and a paper transport direction changing roll 25 that are disposed from the upstream side to the downstream side in the transport direction of the continuous paper P.

The main drive roll 21 has a function of nipping the continuous paper P with predetermined pressure, receiving drive from a main motor (not shown) arranged in the paper transport unit 20, and feeding the continuous paper P at a predetermined transport speed. The aligning roll 22 has a function of keeping a transport route of the continuous paper P invariant in cooperation with a guiding member 23 having a partially cylindrical shape, on the upstream side of the main drive roll 21. The back tension rolls 24 have a function of rotating at a lower speed than that of the main drive roll 21 and applying tension to the continuous paper P, on the upstream side of the main drive roll 21. The paper transport direction changing roll 25 is a driven roll driven by winding and hanging the continuous paper P, and has a function of changing the transport direction of the continuous paper P fed from the main drive roll 21, to the direction toward the image forming unit 30.

The image forming unit 30 includes: a K-color image forming unit 30K forming a toner image of black (K) on the continuous paper P; a C-color image forming unit 30C forming a toner image of cyan (C) on the continuous paper P; an M-color image forming unit 30M forming a toner image of magenta (M) on the continuous paper P; and a Y-color image forming unit 30Y forming a toner image of yellow (Y) on the continuous paper P.

Each of the K-color image forming unit 30K, the C-color image forming unit 30C, the M-color image forming unit 30M and the Y-color image forming unit 30Y includes: a photoconductive drum 31; an electrically charging corotron 32 electrically charging the surface of the photoconductive drum 31 at a predetermined potential; an exposure device 33 exposing the surface of the photoconductive drum 31 on the basis of image data; a developing device 34 developing with each color toner an electrostatic latent image formed on the surface of the photoconductive drum 31; a transfer roll 35 transferring onto the continuous paper P a toner image formed on the surface of the photoconductive drum 31; and a pair of transfer guiding rolls 36 and 37 that are arranged on the upstream and downstream sides of the transfer roll 35, respectively, and press the continuous paper P onto the photoconductive drum 31.

The image forming apparatus 1 of the present exemplary embodiment also includes a mark detection sensor S detecting marks M (see FIG. 2 to be described later), which are an example of marks on the continuous paper P, on the transport route of the continuous paper P in the K-color image forming unit 30K. As shown in FIG. 1, the mark detection sensor S of the present exemplary embodiment is provided on the upstream side of a transfer position in the transport direction of the continuous paper P. Here, the transfer position is formed by the transfer roll 35 and the photoconductive drum 31. The mark detection sensor S is controlled by a comprehensive controller 50 to be described later and reads the marks M on the continuous paper P. Note that, for example, an optical sensor, such as a line CCD, may be used for the mark detection sensor S of the present exemplary embodiment.

The fixing unit 40 includes: a flash fixing device 41 fixing the color toner images formed on the continuous paper P, by flashing; tension application roll members 42 applying tension to the continuous paper P on the downstream side of the flash fixing device 41; an aligning member 43 correcting the route of the continuous paper P in the width direction on the downstream side of the tension application roll members 42; and tension rolls 44 that nip the continuous paper P in the vicinity of an exit, rotate at a higher speed than the transport speed of the continuous paper P, and applies tension to the continuous paper P.

The display D, which is an example of a display, displays the operational status of the image forming apparatus 1, a message to a user, and the like. The display D also functions as an input unit receiving an instruction for an image forming operation from a user. Note that, for example, a touch panel may be used for the display D.

The image forming apparatus 1 further includes: the comprehensive controller 50 controlling the whole operation of the image forming apparatus 1 comprehensively; a paper transport controller 60 controlling the paper transport unit 20; an image forming controller 70 controlling operation of the image forming unit 30; a fixing controller 80 controlling operation of the fixing unit 40; and a display controller 90 controlling the display D. In the image forming apparatus 1 of the present exemplary embodiment, the comprehensive controller 50 comprehensively controls the paper transport controller 60, the image forming controller 70, the fixing controller 80 and the display controller 90.

Note that each of the various controllers includes a central processing unit (CPU), a read only memory (ROM) and a random access memory (RAM). Each of the functions are implemented by the CPU executing processing in accordance with a program stored in the ROM while exchanging data with the RAM.

Figure 2:
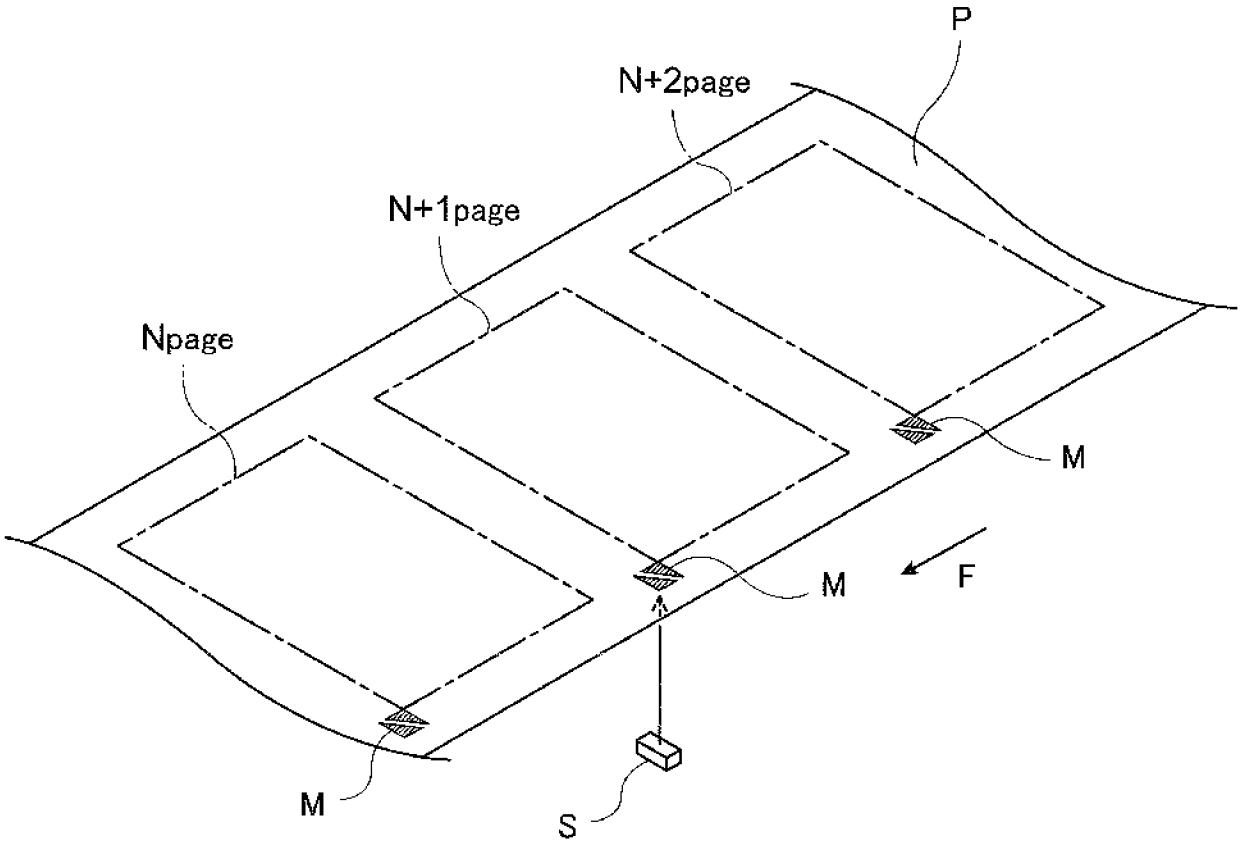
FIG. 2 is a diagram for explaining the marks on the continuous paper.

FIG. 2 is a diagram for explaining the marks M on the continuous paper P.

As shown in FIG. 2, the continuous paper P of the present exemplary embodiment has the plural marks M formed in line at predetermined intervals in the transport direction F. The marks M are used for positioning on the occasion of image formation to the continuous paper P. In the present exemplary embodiment, the continuous paper P subjected to image formation is cut into a size corresponding to the A4 size, thereby to give a sheet of paper. Additionally, as shown in FIG. 2, one mark M is formed on each region corresponding to the A4 size of the continuous paper P (a region corresponding to one page in the example of FIG. 2). Note that, for example, plural marks M may be formed on a region corresponding to one page.

Figure 3:
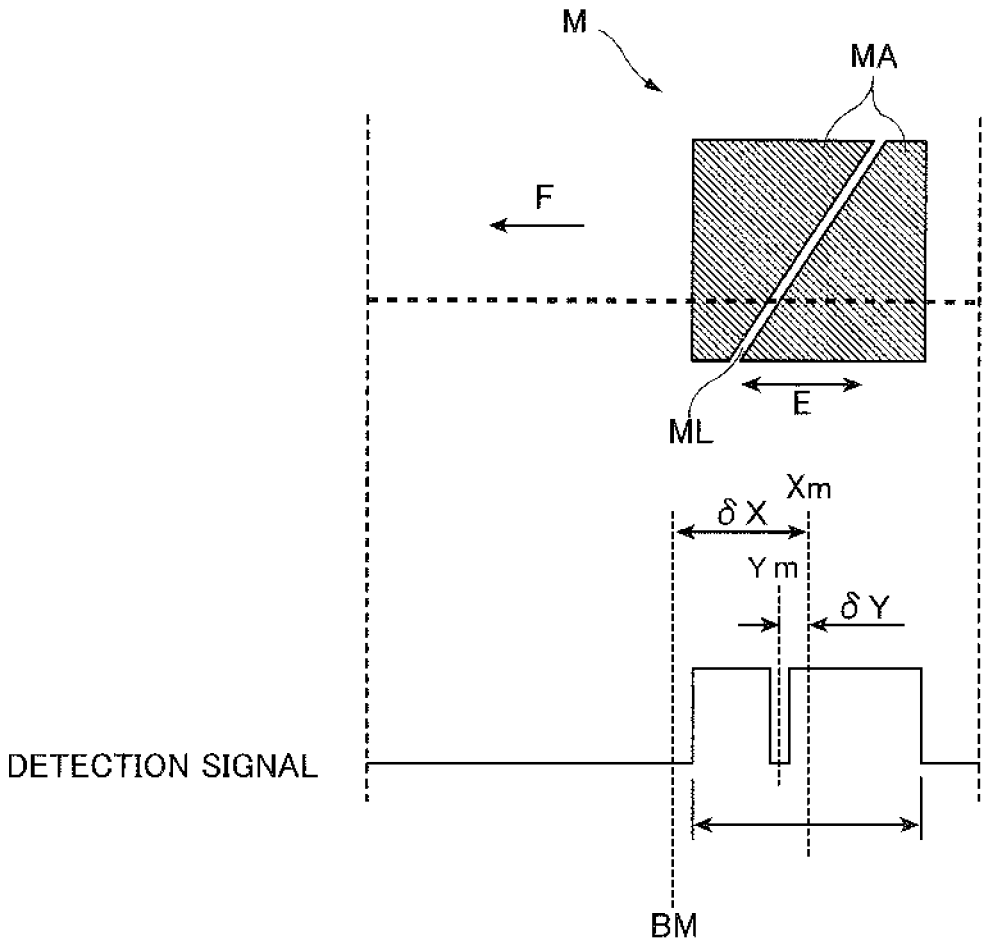
FIG. 3 is a diagram for explaining position adjustment of an image based on reading the marks.

FIG. 3 is a diagram for explaining position adjustment of an image based on reading the marks M. FIG. 3 shows an enlarged view of a mark M together with a waveform of a signal obtained by reading the mark M.

As shown in FIG. 3, the mark M is a rectangular mark composed of a black region MA and a white sloped line portion ML. In the present exemplary embodiment, the mark M is formed so that a lengthwise direction E thereof extends in the transport direction F of the continuous paper P. The white sloped line portion ML is formed so as to slope with respect to the transport direction and to cross the black region MA.

The image forming apparatus 1 of the present exemplary embodiment adjusts the position in the first scan direction and the second scan direction of an image to be formed on the continuous paper P, based on a result of reading the marks M.

The comprehensive controller 50, which is an example of an execution unit, acquires a waveform of a signal obtained by the mark detection sensor S reading the mark M, as shown in FIG. 3. The comprehensive controller 50 calculates a center position Xm in the second scan direction of the read mark M, by use of edge information (rising information and falling information on both edges of the waveform) on the black region MA. The position in the second scan direction of an image to be formed on the continuous paper P is adjusted on the basis of a difference •X between the center position Xm and a predetermined reference position BM. Adjustment in the second scan direction is carried out by controlling timing to start exposure of the photoconductive drum 31.

Additionally, the comprehensive controller 50 calculates a center position Ym in the second scan direction of the white sloped line portion ML, by use of edge information (falling information and rising information on a concave portion at a center portion of the waveform) on the white sloped line portion ML. The comprehensive controller 50 then calculates a difference •Y between the center position Xm in the second scan direction of the mark M and the center position Ym in the second scan direction of the white sloped line portion ML. Since a slope angle of the white sloped line portion ML is specified in advance, the position in the first scan direction of an image to be formed on the continuous paper P is adjusted on the basis of the calculated difference •Y. Adjustment in the first scan direction is carried out by controlling a write-start position in the first scan direction of exposure to the photoconductive drum 31.

The image forming apparatus 1 of the present exemplary embodiment detects a splice Sp (see FIG. 6 to be described later) formed on the occasion of splicing pieces of the continuous paper P, based on a detection result of the marks M by the mark detection sensor S. Detection of the splice Sp will be described later in detail.

Next, the image forming operation of the image forming apparatus 1 is described.

When the image forming apparatus 1 is started, image data is inputted to the comprehensive controller 50 of the image forming apparatus 1 through a communication network, for example. The comprehensive controller 50 divides the inputted image data into pieces of image data respectively corresponding to the K-color, C-color, M-color and the Y-color, and transmits the image data of the respective colors to the image forming controller 70.

In synchronization with the input of the image data to the comprehensive controller 50, the comprehensive controller 50 controls the paper transport unit 20 through the paper transport controller 60 and controls the fixing unit 40 through the fixing controller 80, thereby to cause the continuous paper P to be transported at a predetermined transport speed while applying predetermined tension to the continuous paper P.

Under the control of the comprehensive controller 50, the image forming controller 70 controls formation of each color toner image in the K-color image forming unit 30K, the C-color image forming unit 30C, the M-color image forming unit 30M and the Y-color image forming unit 30Y.

In the K-color image forming unit 30K, the C-color image forming unit 30C, the M-color image forming unit 30M and the Y-color image forming unit 30Y, the photoconductive drum 31 starts rotating, and the surface of the photoconductive drum 31 is electrically charged by the electrically charging corotron 32 at a predetermined potential (for example, −500 V), and further, an electrostatic latent image corresponding to image data of each color is formed by the exposure device 33. The electrostatic latent image on the photoconductive drum 31 is then developed by the developing device 34 with each color toner, to form each color toner image. The color toner image formed on the surface of the photoconductive drum 31 is transferred onto the continuous paper P by the transfer roll 35 and the transfer guiding rolls 36 and 37. Since the continuous paper P successively passes through the K-color image forming unit 30K, the C-color image forming unit 30C, the M-color image forming unit 30M and the Y-color image forming unit 30Y, the respective color toner images are superimposed with each other in order of a K-color toner image, a C-color toner image, an M-color toner image and a Y-color toner image, and thereby a full color toner image is formed on the continuous paper P.

After that, the continuous paper P on which the full color toner image is formed is transported into the fixing unit 40, and then the toner image is fixed to the continuous paper P by the flash fixing device 41. Thereby, a full color image is formed on the continuous paper P.

When the continuous paper P placed in the continuous paper feeder 300 of the image forming apparatus 1 runs out, new continuous paper P is connected to the placed continuous paper P so as to be continuously used. On this occasion, a splice Sp (see FIG. 6 to be described later) is formed at a portion with which the already set continuous paper P and the new continuous paper P are spliced. Since the splice Sp for splicing plural pieces of the continuous paper P may not be used, no image formation is usually performed at the portion of the splice Sp.

The image forming apparatus 1 of the present exemplary embodiment detects from the continuous paper P (a connective belt-shaped medium) a position at which the splice Sp is formed, by using the marks M formed on the continuous paper P. When the image forming apparatus 1 detects a splice Sp, the image forming apparatus 1 performs, as processing on the splice, processing that causes no image to be formed at the portion of the splice Sp on the continuous paper P.

Figure 4:
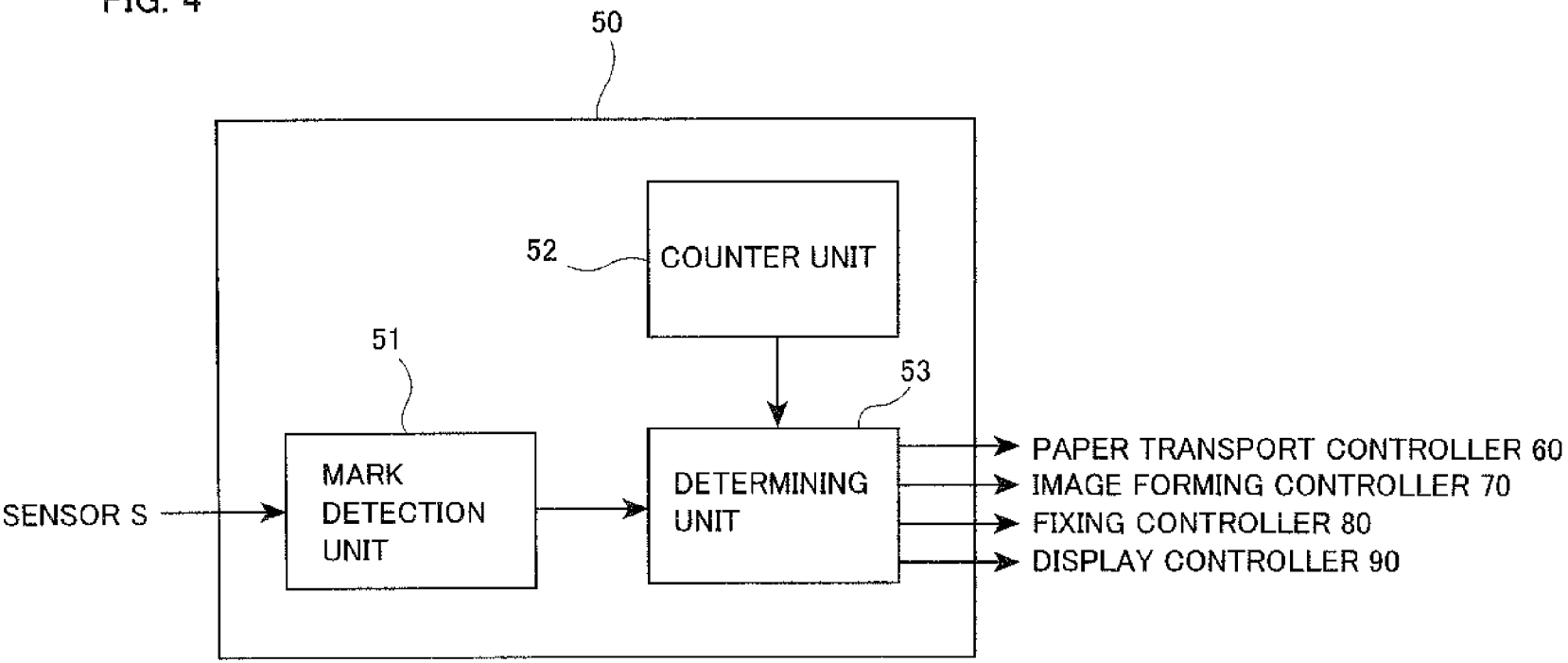
FIG. 4 is a diagram of a functional block to implement a function of determining the splice executed in the comprehensive controller.

FIG. 4 is a diagram of a functional block to implement a function of determining the splice Sp executed in the comprehensive controller 50.

As shown in FIG. 4, the comprehensive controller 50 includes: a mark detection unit 51 detecting the marks M on the continuous paper P by controlling the mark detection sensor S; a counter unit 52 measuring transport time of the continuous paper P; and a determining unit 53 determining the presence or absence and the like of the splice Sp based on a result of reading the marks M acquired from the mark detection unit 51.

The mark detection unit 51, which is an example of a detection unit, reads the marks M on the continuous paper P by means of the mark detection sensor S. The mark detection unit 51 acquires a read signal from the mark detection sensor S. The mark detection unit 51 temporarily stores, as a detection signal of a mark M, a signal that is read when an enable signal generated at predetermined timing is ON (see FIG. 5 to be described later). The mark detection unit 51 then transmits the acquired detection signal of the mark M to the determining unit 53. In this manner, in the present exemplary embodiment, the marks M are detected on the basis of the enable signal, and thus a condition under which the enable signal is constructed is called a detection condition of the marks M.

In the present exemplary embodiment, a description is given by use of an example in which the enable signal is generated by the mark detection unit 51; however, the mark detection unit 51 may be configured to receive the enable signal from outside.

The mark detection unit 51 also determines whether the waveform of the detection signal is that of the mark M or not. That is, the mark detection unit 51 is configured so as not to determine a waveform caused by those other than the marks M such as a stain, for example, as that of the detection signal of a mark M. For example, the mark detection unit 51 compares the prestored size of the marks M formed on the continuous paper P with the size of a reading target calculated on the basis of the transport speed of the continuous paper P and a time interval between rising and falling of edges of the waveform of the reading target. The mark detection unit 51 then determines whether the waveform of the detection signal is that of a mark M or not, according to the comparison result of both sizes.

Figure 5:
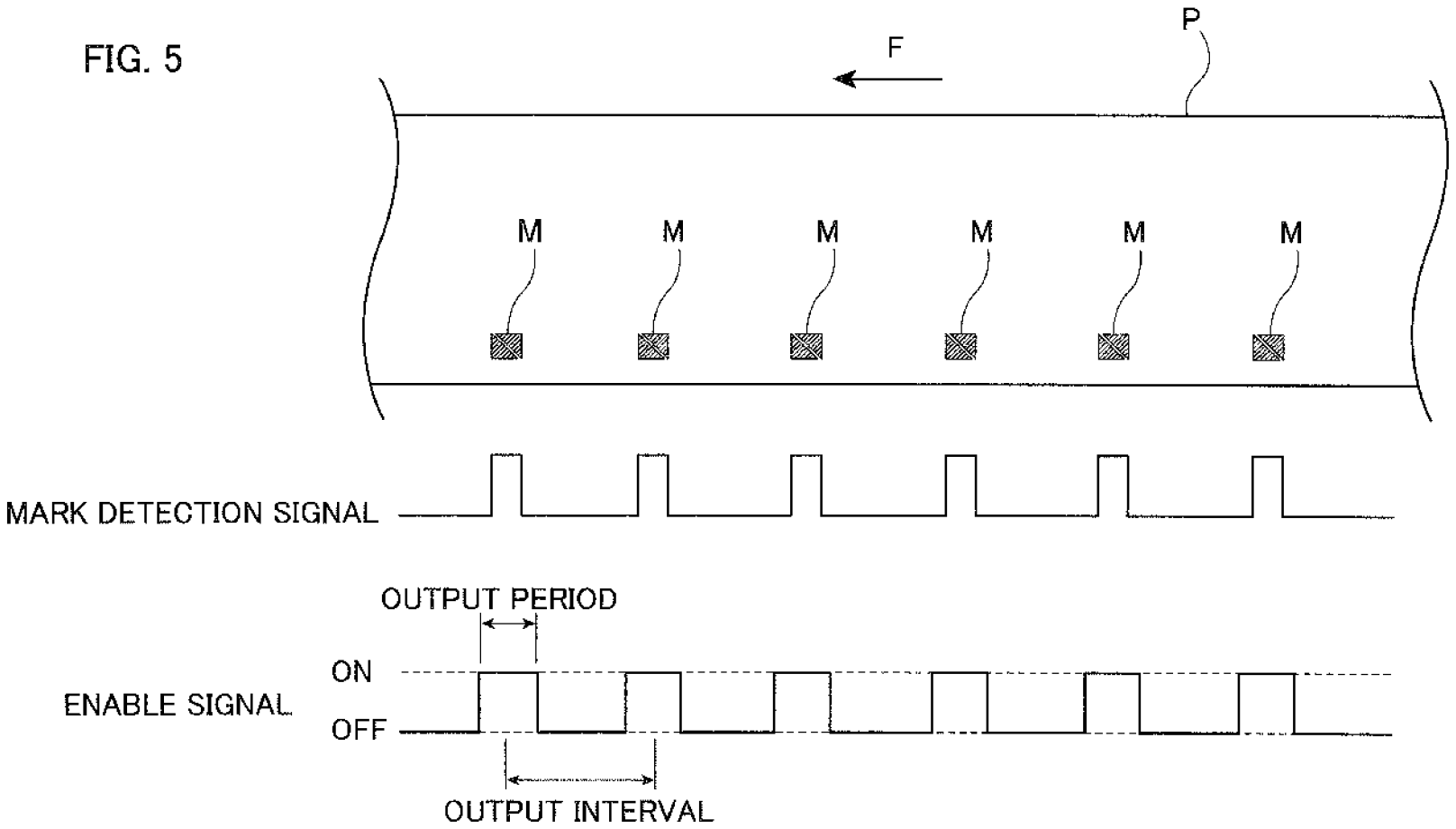
FIG. 5 is a diagram for explaining mark detection in the ordinary state.
Figure 6:
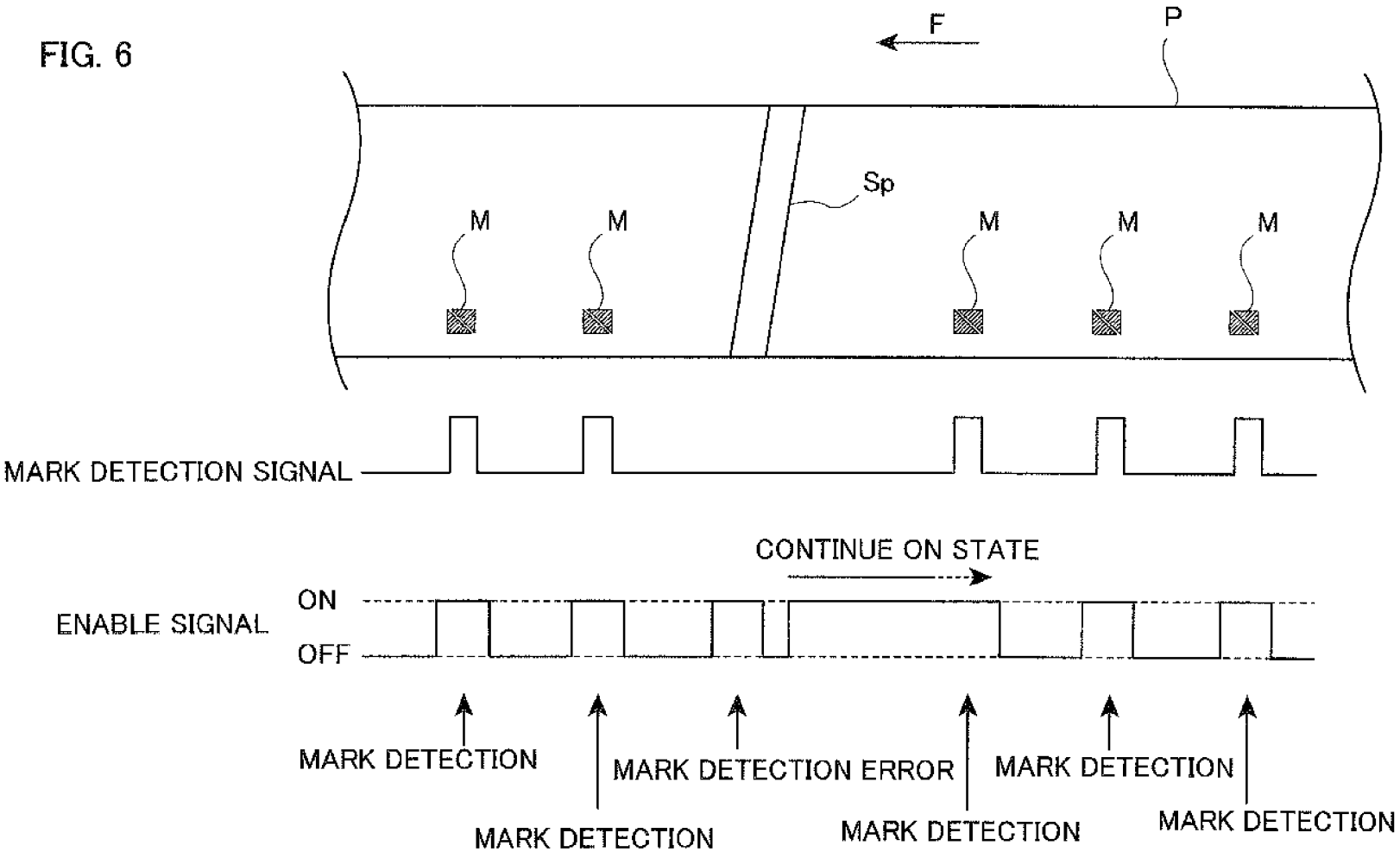
FIG. 6 is a diagram for explaining the mark detection on the occasion of passage of the splice.

Next, referring to FIGS. 5 and 6, a more specific description is given of a function for the mark detection unit 51 to detect the marks M. Note that a state where no splice Sp is formed, the marks M are formed on the continuous paper P at predetermined intervals and the continuous paper P is transported at a predetermined speed will be referred to as "ordinary state" in the following description.

FIG. 5 is a diagram for explaining mark detection in the ordinary state. FIG. 6 is a diagram for explaining the mark detection on the occasion of passage of the splice Sp.

In the ordinary state, the marks M formed on the continuous paper P at predetermined intervals pass through the mark detection sensor S. As shown in FIG. 5, the mark detection unit 51 acquires a detection signal of the marks on the continuous paper P from the mark detection sensor S.

Additionally, as shown in FIG. 5, the mark detection unit 51 generates an enable signal having an output period and an output interval defined on the basis of the marks M on the continuous paper P. The output period of the enable signal of the present exemplary embodiment is set at a period in which a detection signal over the whole of a mark M may be acquired. The output interval of the enable signal of the present exemplary embodiment is set on the basis of the intervals of the marks M formed on the continuous paper P. Note that, in the present exemplary embodiment, one mark M is formed for each region corresponding to one page formed in the continuous paper P (see FIG. 2). Accordingly, in the present exemplary embodiment, the output interval of the enable signal is set on the basis of the interval corresponding to one page formed in the continuous paper P. Note that, in the following description, a condition to detect the marks M in the ordinary state will be referred to as "ordinary detection condition."

As described above, the mark detection unit 51 establishes correspondences between timing at which a mark M formed on the continuous paper P passes through the mark detection sensor S and output timing of the enable signal. Accordingly, in the ordinary state, the marks M are detected every time the enable signal changes to the ON state, as shown in FIG. 5.

Next, a description is given of a case where the splice Sp passes through the mark detection sensor S.

As shown in FIG. 6, in the spliced continuous paper P, intervals of the marks M usually have a difference between front and back of the portion at which the splice Sp is formed. Thus, intervals of the marks M front and back of the splice Sp are different from original intervals of the marks M with regard to timing at which the marks M on the transported continuous paper P pass through the mark detection sensor S.

Under the above circumstances, the mark detection unit 51 detects the marks M on the basis of the enable signal based on the above ordinary detection condition. As shown in FIG. 6, the first and second marks M on the downstream side in the transport direction of the continuous paper P are detected by the mark detection unit 51 every time the enable signal changes to the ON state. However, the mark detection unit 51 does not detect another mark M at timing when the enable signal further changes to the ON state next time, because formation of the splice Sp makes the interval of the marks M different from the original intervals of the marks M. The mark detection unit 51 transmits information on an error of detecting no marks M (hereinafter, referred to as "mark detection error") if the enable signal is in the ON state and detection of the mark M has failed like this.

The mark detection unit 51 further changes the output period of the enable signal from that of the ordinary detection condition if the enable signal is in the ON state and no mark M is detected, as shown in FIG. 6. In the present exemplary embodiment, the mark detection unit 51 maintains the enable signal in the ON state until a new mark M is detected after the mark detection error occurs.

When the mark detection unit 51 detects a new mark M, the mark detection unit 51 resets the output period and the output interval of the enable signal from this detection time point onward to those before the mark detection error is detected (those of the ordinary detection condition) (hereinafter, referred to as "return processing"). Specifically, as shown in FIG. 6, the mark detection unit 51 sets the output period of the enable signal so that a detection signal over the whole (the length in the transport direction of the continuous paper P) of a mark M may be acquired, and sets the output interval of the enable signal based on the intervals of the marks M formed on the continuous paper P. After the return processing, the mark detection unit 51 further detects a new mark M and transmits the detection signal of the mark M to the determining unit 53.

The counter unit 52, which is an example of a measuring unit, measures transport time of the continuous paper P. The counter unit 52 of the present exemplary embodiment measures the transport time of the continuous paper P based on operation time of the main drive roll 21 of the paper transport unit 20 transporting the continuous paper P. Additionally, the counter unit 52 of the present exemplary embodiment uses as a reference a time point at which transportation of the continuous paper P is stopped, and measures the transport time of the continuous paper P from when the transportation is restarted afterward.

The image forming apparatus 1 of the present exemplary embodiment has to stop transporting the continuous paper P on the occasion of splicing the continuous paper P. Thus, the image forming apparatus 1 of the present exemplary embodiment regards a stop of transportation of the continuous paper P as an action of splicing. In the present exemplary embodiment, the counter unit 52 measures a value related to the amount of the continuous paper P transported from when transportation of the continuous paper P is restarted, and thereby the image forming apparatus 1 grasps an approximate position of the splice Sp.

In the present exemplary embodiment, the position of the splice Sp grasped as described above is used for determination of detecting the splice Sp by the determining unit 53, which will be described later in detail.

Note that it is enough for the counter unit 52 to be capable of measuring a value increasing together with transportation of the continuous paper P in order to grasp the value related to the amount of the transported continuous paper P. For example, the value related to the amount of the transported continuous paper P may be grasped by the counter unit 52 measuring the number of the detected marks M.

The counter unit 52 also holds information on transport time (hereinafter, referred to as "expected arrival time") enough for that splice Sp to pass through the mark detection sensor S which is formed when an operation to splice pieces of the continuous paper P is carried out in the continuous paper feeder 300, for example. The expected arrival time (a reference value) need not be strictly set, but may be a value of a rough indication. Specifically, the expected arrival time is set as a rough estimation based on the distance from the splicing position of the continuous paper P to the mark detection sensor S and the transport speed of the continuous paper P.

Note that the expected arrival time may not be necessarily set in order to detect the splice Sp because the image forming apparatus 1 of the present exemplary embodiment is configured to determine the detection of the splice Sp based on detected intervals of the marks M. However, in the present exemplary embodiment, the expected arrival time is definitely set, and thereby (ii) determination of a breakdown or the like of the apparatus and (iii) determination of presenting a confirm message are carried out, which will be described later in detail.

For example, when splicing is completed and image formation is restarted, the counter unit 52 measures transport time of the continuous paper P. The counter unit 52 then considers a flag to be in an ON state during a period when the measured transport time is less than the expected arrival time, and transmits information indicating that the flag is ON to the determining unit 53. Meanwhile, the counter unit 52 considers the flag to be in an OFF state if the measured transport time exceeds the expected arrival time, and transmits information indicating that the flag is OFF to the determining unit 53.

The determining unit 53 determines the presence or absence of the splice Sp on the continuous paper P, and the like, in accordance with a result of reading the marks M acquired from the mark detection unit 51. Specifically, based on the information acquired from the mark detection unit 51 and the counter unit 52, the determining unit 53 of the present exemplary embodiment carries out any one of the following determination: (i) determination of detecting the splice Sp, (ii) determination of a breakdown or the like of the apparatus and (iii) determination of presenting a confirm message. In accordance with the types of the above determination, the determining unit 53 transmits an instruction about operation control to the paper transport controller 60, the image forming controller 70, the fixing controller 80 and the display controller 90.

A description is given of (i) determination of detecting the splice Sp by the determining unit 53.

When the determining unit 53 acquires information on the mark detection error from the mark detection unit 51, the determining unit 53 determines whether the mark detection error is caused by the splice Sp.

When the determining unit 53 acquires the information on the mark detection error, the determining unit 53 first confirms whether flag information acquired from the counter unit 52 is ON or OFF. If the flag information from the counter unit 52 is "ON," the determining unit 53 determines that the mark detection error is caused by the splice Sp formed on the continuous paper P. The determining unit 53 then determines that the splice Sp exists at a position on the continuous paper P identified by the mark M causing the mark detection error.

In the present exemplary embodiment, the period during which the flag is in the ON state is assumed to be a period in which the splice Sp may pass through the mark detection sensor S. Accordingly, if the mark detection error occurs when the flag information is "ON," the determining unit 53 determines that the splice Sp is detected.

If the splice Sp is detected, the determining unit 53 causes the paper transport controller 60, the image forming controller 70 and the fixing controller 80 to execute splice processing, which is executed when a splice is detected. In the present exemplary embodiment, the determining unit 53 transmits an instruction to execute, as the splice processing, non-printing by which no image is formed on the splice Sp of the continuous paper P identified by the mark M causing the mark detection error. The determining unit 53 also informs the display controller 90 of detection of the splice Sp.

Note that, as the splice processing, an image expressing the splice Sp may be formed at the position of the splice Sp of the continuous paper P, for example.

The mark detection unit 51 then carried out the return processing after the mark detection error occurs, as described with reference to FIG. 6. When a detection result of the mark M is transmitted from the mark detection unit 51 to the determining unit 53 after the return processing, the determining unit 53 determines whether the ordinary state is restored or not. Specifically, the determining unit 53 determines that the ordinary state is restored, if two marks M are consecutively detected, for example, when the return processing is carried out and then an ordinary detecting state is restored. The determining unit 53 then transmits an instruction to cancel the non-printing and to restart ordinary image formation to the image forming controller 70 and the fixing controller 80.

Next, a description is given of (ii) determination of a breakdown of the apparatus by the determining unit 53.

When the determining unit 53 acquires information on the mark detection error, the determining unit 53 confirms whether flag information acquired from the counter unit 52 is ON or OFF, as in the above case of (i) determination of detecting the splice Sp. If the flag information from the counter unit 52 is "OFF," the determining unit 53 determines that the mark detection error is caused by a breakdown of the apparatus, such as transportation failure due to a trouble of the paper transport unit 20, for example.

In the present exemplary embodiment, the period during which the flag information of the counter unit 52 is OFF is assumed to be a period after the splice Sp has already passed through the mark detection sensor S. Accordingly, in the present exemplary embodiment, if the mark detection error occurs when the flag information indicates the OFF state, the determining unit 53 determines that the cause of the mark detection error is not the splice Sp but a breakdown of the apparatus.

The determining unit 53 then informs the display controller 90 of the determination result of a breakdown or the like of the apparatus. The determining unit 53 of the present exemplary embodiment also instructs the paper transport controller 60, the image forming controller 70 and the fixing controller 80 to stop transporting the continuous paper P and to stop image formation on the continuous paper P.

Finally, a description is given of (iii) determination of presenting a confirm message by the determining unit 53.

In the present exemplary embodiment, when flag information acquired from the counter unit 52 changes from ON to OFF, the determining unit 53 confirms whether information on the mark detection error has been acquired from the mark detection unit 51 in the period during which the flag information indicates the ON state. If the determining unit 53 confirms that the information on the mark detection error has not been acquired in the period during which the flag information indicates the ON state, the determining unit 53 causes a user to be informed of a confirm message.

The status where the information on the mark detection error has not been acquired in the period during which the flag information indicates the ON state is supposed to be either of the following two cases. One of them is a case where the mark detection error (the splice Sp) has not been found in the period during which the flag information indicates the ON state because of a trouble and the like of the mark detection sensor S, for example, although the continuous paper P is spliced. The other is a case where the continuous paper P is not spliced and transportation of the continuous paper P (the image forming operation) has stopped because of a reason other than splicing.

Therefore, in the present exemplary embodiment, the determining unit 53 outputs a determination result to present a confirm message so that a user may confirm either of the following: there is a possibility that the splice Sp has been missed because of a trouble and the like of the mark detection sensor S, as described above; or the continuous paper P is not spliced to begin with and thus detecting no splice Sp causes no problem. The determining unit 53 then transmits to the display controller 90 the determination result to present the confirm message. Note that, in general, the probability of occurrence of a trouble of the mark detection sensor S is supposed to be relatively small. Thus, in the present exemplary embodiment, when presenting a confirm message is determined, image formation is continued without interruption.

Figure 7A:
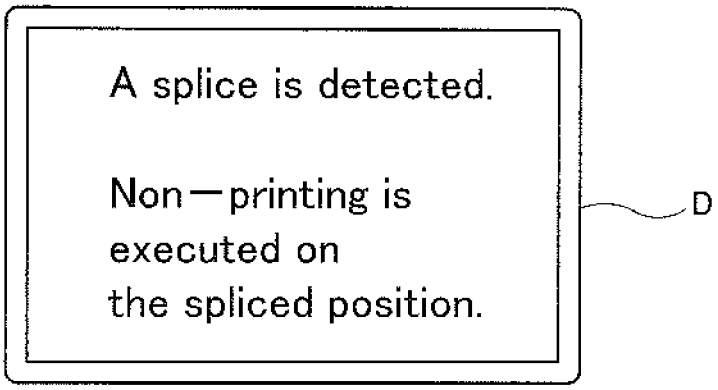
FIGS. 7A to 7C are diagrams showing displayed information on the display in accordance with a determination result of the determining unit.
Figure 7B:
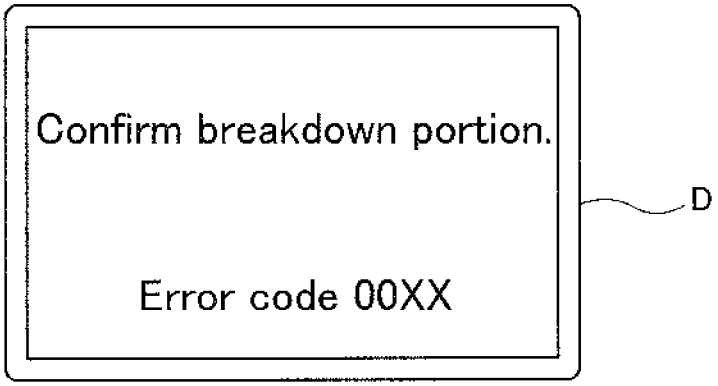
Figure 7C:
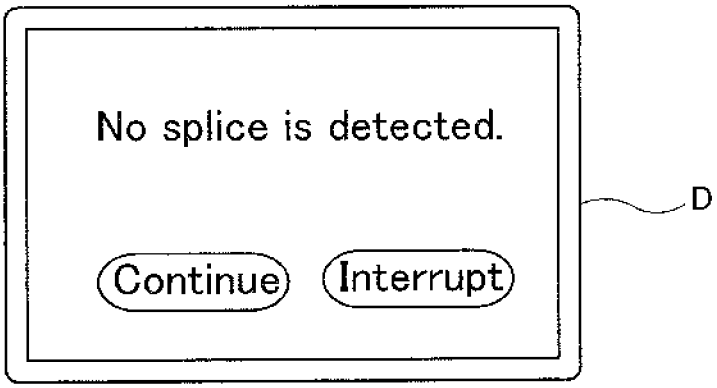

FIGS. 7A to 7C are diagrams showing displayed information on the display D in accordance with a determination result of the determining unit 53.

First, a description is given of a case where detection of the splice Sp is determined by the determining unit 53.

If the display controller 90 receives from the determining unit 53 information that the splice Sp is detected, the display controller 90 causes a message of "A splice is detected." to be displayed on the display D, as shown in FIG. 7A. In addition, the display controller 90 may cause information on a countermeasure depending on the detection of the splice Sp to be displayed, if the non-printing is executed along with the detection of the splice Sp, as in the present exemplary embodiment.

Next, a description is given of a case where a breakdown or the like of the apparatus is determined by the determining unit 53.

If the display controller 90 receives from the determining unit 53 information that the breakdown or the like is determined, the display controller 90 causes a message of "Confirm the breakdown portion." to be displayed on the display D, as shown in FIG. 7B. At this time, if the portion or the cause of the breakdown is identified, this information may be displayed by use of an error code or the like, for example.

Then, a description is given of a case where presenting a confirm message is determined by the determining unit 53.

If the display controller 90 receives from the determining unit 53 information that presenting a confirm message is determined, the display controller 90 causes a message of "No splice is detected." to be displayed on the display D, as shown in FIG. 7C. In this case, an instruction of a subsequent operation may be received from a user through the display D.

For example, information may be displayed to receive an instruction to interrupt the image forming operation for a case where no splice Sp has actually been detected although the splice Sp should have been detected, for example. Additionally, information may be displayed to receive an instruction to continue the image forming operation for confirmation when the continuous paper P is not spliced to begin with and thus detecting no splice Sp causes no problem.

Figure 8:
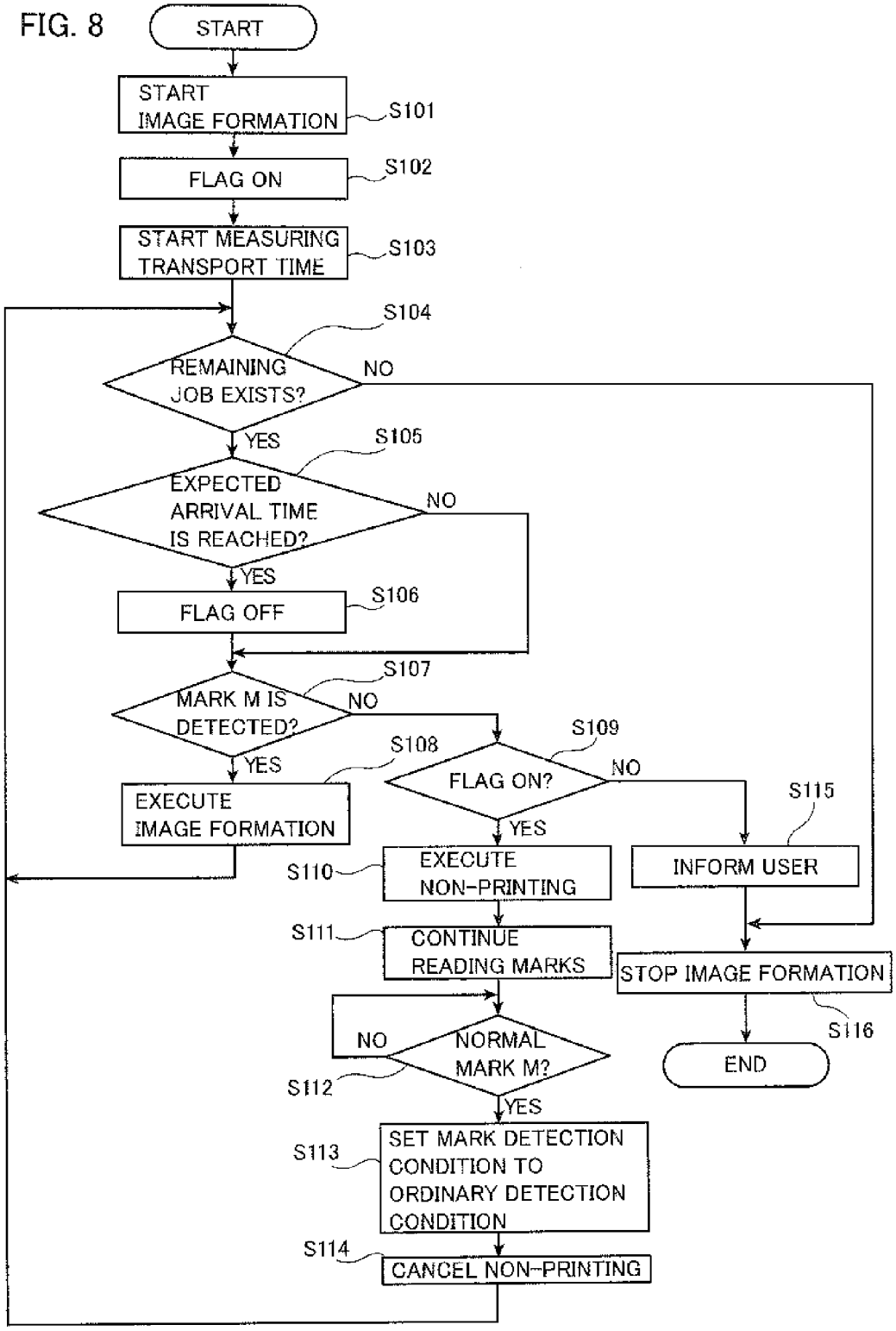
FIG. 8 is a diagram showing an operational flow of the image forming apparatus in accordance with mark detection.

FIG. 8 is a diagram showing an operational flow of the image forming apparatus 1 in accordance with mark detection.

Note that FIG. 8 shows an operational flow after splicing the continuous paper P is carried out and then image formation (paper transportation) is restarted.

When splicing the continuous paper P is completed and the comprehensive controller 50 receives an instruction to restart image formation, the comprehensive controller 50 instructs the paper transport controller 60, the image forming controller 70 and the fixing controller 80 to start the image forming operation (Step 101). At this time, the counter unit 52 of the comprehensive controller 50 sets the flag to the ON state (Step 102), and the counter unit 52 starts measuring transport time (Step 103).

The comprehensive controller 50 then determines whether a job received prior to splicing the continuous paper P remains or not. If no job remains (No in Step 104), the comprehensive controller 50 stops the image forming controller 70 and the like to finish image formation (Step 116). On the other hand, if a job remains (Yes in Step 104), the process continues to confirmation of the transport time by the counter unit 52. The counter unit 52 then determines whether the measured transport time of the continuous paper P has reached the expected arrival time or not. If not, the process continues to mark detection by the mark detection unit 51 (No in Step 105). On the other hand, the measured transport time of the continuous paper P by the counter unit 52 has reached the expected arrival time (Yes in Step 105), the counter unit 52 sets the flag to the OFF state (Step 106) and the process continues to the mark detection by the mark detection unit 51.

The mark detection unit 51 then detects the marks M formed on the continuous paper P based on the ordinary detection condition, as described with reference to FIG. 5. If a mark M is detected by the mark detection unit 51 (Yes in Step 107), image formation onto the continuous paper P is carried out (Step 108). After that, the process returns to Step 104 and the image formation is sequentially carried out.

On the other hand, if a mark M is not detected by the mark detection unit 51 (No in Step 107) as described with reference to FIG. 6, whether the flag information of the counter unit 52 is ON or OFF is confirmed (Step 109).

If the flag of the counter unit 52 is in the ON state in Step 109, the comprehensive controller 50 causes the paper transport controller 60 and the image forming controller 70 to execute the non-printing (Step 110). That is, since the mark detection error is confirmed in Step 107 and the flag is confirmed to be ON in Step 109, the determining unit 53 makes (i) determination of detecting the splice Sp so that no image is formed on the splice Sp. The mark detection unit 51 further continues reading the marks M after the mark detection error occurs (Step 111), as described with reference to FIG. 6. The mark detection unit 51 then starts detecting the marks M again.

The mark detection unit 51 now determines whether the waveform of a signal read by the mark detection sensor S is that of a mark M or not (Step 112). If the mark detection unit 51 determines that the waveform of the read signal is not that of the mark M (No in Step 112), the mark detection unit 51 determines whether the waveform of another signal newly read by the mark detection sensor S is that of a mark M or not. In this manner, the mark detection unit 51 repeats analysis of the waveforms of the read signals until the mark detection unit 51 detects a normal mark M. If the mark detection unit 51 determines that the waveform of the read signal is that of a mark M (Yes in Step 112), the mark detection unit 51 carries out the return processing to restore the detection condition of the marks M to the ordinary detection condition (Step 113). The determining unit 53 further transmits an instruction to cancel the non-printing to the paper transport controller 60 and the image forming controller 70 (Step 114). After that, the process returns to Step 104, and if there is a remaining job, the image forming operation continues in accordance with the above flow.

Meanwhile, if the mark detection error occurs in Step 107 and the flag of the counter unit 52 is confirmed to be in the OFF state in Step 109, the determining unit 53 determines that the cause of the mark detection error is not the splice Sp but a breakdown or the like of the apparatus. That is, it is a case where the determining unit 53 makes (ii) determination of a breakdown or the like of the image forming apparatus 1. The determining unit 53 causes the display controller 90 to inform the display D of the determination result of the breakdown or the like. The display D then informs a user of the breakdown of the apparatus (Step 115). The determining unit 53 further transmits an instruction to stop image formation to the image forming controller 70 and the like (Step 116).

As described above, the image forming apparatus 1 of the present exemplary embodiment determines the presence or absence of the splice Sp on the continuous paper P, and the like, by using the marks M formed on the continuous paper P, without requiring a user to do an additional operation to detect the splice Sp.

In the present exemplary embodiment, the presence or absence of the splice Sp is determined on the basis of the marks M formed on the continuous paper P for positioning; however, the present invention is not limited to the marks M for positioning. The marks used for determining the splice Sp only have to be those which are formed in line at predetermined intervals in the lengthwise direction of the continuous paper P and are readable by a sensor or the like. For example, if feed holes of paper are formed at both edge portions of the continuous paper P, these feed holes may be regarded as the marks and detection of the splice Sp and the like may be determined on the basis of the intervals of the feed holes.

Additionally, the technique of the present exemplary embodiment may be applied not only to the continuous paper P in the image forming apparatus 1, but also to other techniques as long as they perform processing on a belt-shaped medium and the medium has marks formed at predetermined intervals in the transport direction. For example, there is known a packaging bag in which packaged material, such as liquid or powder, are filled to seal. For such a packaging bag, a belt-shaped film is prepared in advance and marks to identify positions on the film are provided at predetermined intervals. Accordingly, in an apparatus dealing with packaging bags, the presence or absence of a splice may be determined on the basis of the intervals of the marks if belt-shaped films are spliced. Then, in accordance with the determination result of the splice, processing may be performed while a portion of the splice is skipped without processing the portion of the splice.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method for forming an image comprising:

transporting a belt-shaped medium having a plurality of marks formed along a line at predetermined intervals in a transport direction;

detecting the marks on the medium and generating a mark detection error if the mark is not detected at the predetermined interval;

determining if the mark detection error occurs during an expected arrival time of a splice;

forming an image on the belt-shaped medium, wherein if it is determined that the mark detection error occurs within the expected arrival time of the splice no image is formed on the splice, and if the mark detection error does not occur during the expected arrival time of the splice, a user is informed and image formation is stopped.

2. A non-transitory computer readable medium storing a program that causes a computer to execute a process for splice processing, the process comprising:

transporting a connective belt-shaped medium having belt-shaped media connected with splices, the belt-shaped media each having a plurality of marks formed along a line at predetermined intervals in a transport direction;

detecting the marks on the connective belt-shaped medium and generating a mark detection error if the mark is not detected at the predetermined interval; and executing splice processing to determine if the mark detection error occurs during an expected arrival time of a splice, wherein if it is determined that the mark detection error occurs within the expected arrival time of the splice no image is formed on the splice, and if the mark detection error does not occur during the expected arrival time of the splice, a user is informed and image formation is stopped.

* * * * *